US006300717B1

(12) United States Patent
Ooms

(10) Patent No.: US 6,300,717 B1
(45) Date of Patent: Oct. 9, 2001

(54) UNIT OF ELECTRIC LAMP AND REFLECTOR

(75) Inventor: Leo F. M. Ooms, Turnhout (BE)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/218,555

(22) Filed: Dec. 22, 1998

(30) Foreign Application Priority Data

Dec. 22, 1997 (EP) ..... 97204071

(51) Int. Cl.[7] ..... H01J 13/46

(52) U.S. Cl. ..... 315/56; 362/310; 362/297; 313/113; 313/318.11

(58) Field of Search ..... 315/56, 82; 362/301, 362/310, 226, 296, 341, 297, 347; 313/113, 116, 318.02, 318.11, 318.12

(56) References Cited

U.S. PATENT DOCUMENTS

| | | | | |
|---|---|---|---|---|
| 3,654,471 | * | 4/1972 | Nilsson | 250/505.1 |
| 4,021,659 | * | 5/1977 | Wiley | 240/41.36 |
| 4,423,348 | * | 12/1983 | Greiler | 313/113 |
| 4,969,072 | * | 11/1990 | Pye | 362/310 |
| 4,994,948 | * | 2/1991 | Cooch | 362/346 |
| 5,506,464 | | 4/1996 | Ooms | 313/113 |
| 5,568,967 | * | 10/1996 | Sikkens et al. | 362/328 |
| 5,744,901 | * | 4/1998 | Friederichs et al. | 313/113 |
| 5,839,818 | * | 11/1998 | Janson et al. | 362/226 |

* cited by examiner

*Primary Examiner*—Haissa Philogene
(74) *Attorney, Agent, or Firm*—Dicran Halajian

(57) ABSTRACT

The electric lamp-reflector unit has a molded reflector body (1) comprising adjusting lugs (22) integral with a reflector part (2) positioned at the light emission window (28).

6 Claims, 2 Drawing Sheets

UNIT OF ELECTRIC LAMP AND REFLECTOR

BACKGROUND OF THE INVENTION

The invention relates to a unit of an electric lamp and a reflector, comprising a reflector body including a reflector part with a concave reflecting surface having an optical axis, and a hollow neck-shaped portion and a light emission window surrounding said optical axis and integral with said reflector body;

an electric lamp comprising a light-transmitting lamp vessel sealed in a vacuumtight manner, enclosing a cavity and having, a first and a second mutually opposing sealed end portion, an electric element arranged in the cavity and respective current conductors connected to the electric element, extending through said sealed end portions and issuing from the lamp vessel to the exterior, the electric lamp being fixed in the reflector body with the first end portion inside the neck-shaped portion, While the cavity lies within the reflecting portion and the electric element is on the optical axis.

A similar unit of electric lamp and reflector is known from EP 0 595 412, U.S. Pat. No. 5,506,464.

The known lamp and reflector may be used for projection purposes, such as film or slide projection, but also in projection-television sets. In these projection television sets there is, just like film and slide projection, in a plane perpendicular to the optical axis of the reflector a light transmitting picture carrier, for example, an LCD screen or a DMD (Digital Mirror Device) screen. Such picture carriers are generally rectangular, for example, having an aspect ratio of 4/3 or 16/9.

The object of the unit of electric lamp and reflector is to clearly light the picture carrier substantially uniformly, so that an optical system which may contain a projection lens can display the image in a clear and uniform manner on a screen so as to have it watched.

The uniformity of the lighting, however, may be adversely affected by an inaccurate positioning of the unit in the optical system. The alignment of the unit in the optical system is generally effected by means of pressing a transparent plate closing off the reflector against a reference face of the optical system. During this operation, scratches may appear on the transparent plate which are detrimental to the clarity of the lighting. If no transparent plate is present, the alignment is effected by means of a pressing flange on the side of the light emission window. Detrimental to the alignment with the aid of the transparent plate and/or the pressing flange is that they are to be flat because otherwise the orientation of the unit relative to the reference face in the optical system may vary.

The positioning of the unit in the optical system requires some clearance for maneuvering. The unit may change place in the optical system, for example, as a result of differences in expansion at high operating temperatures, because when the unit is fixed in the optical system, it is possible for a displacement to occur in a plane transverse to the optical axis of the unit. This clearance may lead to an unfavorable situation during operation of the device in which situation the optical axes of the unit and the optical system no longer coincide, which has a detrimental effect on the clarity and the degree of uniformity of the lighting.

SUMMARY OF THE INVENTION

According to the invention, the reflector body has lugs on the side of the light emission window that faces away from the reflecting surface.

The advantage of the lugs on the reflector body is that the positioning of the unit in the optical system of the device is highly accurate. By making the lugs slightly taper, they may be easily accommodated in the recesses of the reflector system and have a self-alignment effect. The operation of positioning the unit in the optical system is thus simple and accurate by exerting pressure on the pressing flange of the reflector body. In addition, this assures that a displacement transverse to the optical axis is hardly possible.

It is known that three points always define a plane. By utilizing three lugs when the unit is aligned, they are always in one plane and no change of orientation can occur, which change of orientation does occur when the transparent plate and/or pressing flange is aligned to. Since the lugs may be used as references when the electric lamp and reflector are assembled in an assembly line, a good positioning is automatically obtained if these same lugs in the same orientation are utilized when the unit is inserted into the optical system.

The two above-mentioned advantages result in a better aligned unit and optical system so that the brightness and uniformity of the lighting are considerably improved.

Due to the fact that the reflector body is tapered towards the light emission window which body, as a result, has side faces and causes the unit to have a substantially rectangular shape in front elevation, the unit of electric lamp and reflector has a relatively small build-in height. This small build-in height is important for the application of the unit in small, portable devices. A characterizing feature for this unit of electric lamp and reflector is the relatively deep positioning of the electric lamp in the neck of the reflector body, possible by the relatively small focal distance of the reflector, combined with a very short light-emitting part of the electric element, for example 1.3 mm and the slight narrowing in the neck portion. As a result, the greater part of the generated light is reflected and effectively utilized by the backpart of the reflector. This is only possible if the positioning of the electric lamp in the reflector body and optical system is determined very accurately for which the use of the lugs is essential. When the unit is assembled and aligned, the side faces may be used for determining the orientation and further improving the positioning. Surprisingly, it has turned out that as a result of these measures, there is a significant increase of the clarity of the lighting of about 3%.

It is favorable for the safety of the unit when the reflector body is closed off by a transparent plate. This may prevent that flammable objects come into contact with hot elements of the lamp. The risk involved in an explosion of the lamp vessel can also be reduced by this. The transparent plate may be fixed to the reflector body by an adhesive compound, for example, silicone glue. Alternatively, the transparent plate may be fastened by mechanical means, for example, by a metal ring flanged around the reflector body. Instead, a clamping ring or a number of clamps may also be used. The transparent plate may also have an optical function, for example, a color correction filter or a positive lens, for example, to avoid possible relatively small edge losses when projected on a screen. For a constant proper positioning of the unit in an optical system, it is essential for the transparent plate not to disturb the function of the lugs. This is achieved by having the transparent plate sink into the reflector body, so that the lugs continue to protrude from the transparent plate in the direction of the optical axis.

For still further reducing the build-in height of the unit, the pressing flange with the rectangularly shaped reflector is replaced by pressing faces which are found on the lug sides turned towards the neck portion. For reinforcing the lugs, they are slightly thickened in the direction of the neck portion along the optical axis. The corners of the rectangularly shaped reflector are slightly rounded. A corner gives room to a pressing face without this affecting the build-in height and reflecting surface of the unit. On the other hand, the omission of the pressing flange while the build-in height is kept the same causes an enlargement of the reflecting surface and thus a still more efficient use of the light generated by the electric lamp.

It is favorable to give the transparent plate an anti-reflecting coating on either or both sides. This achieves that light losses due to reflection of the respective surface which may be about 4% of the incident light, are reduced or well-nigh avoided. A surface may have a coating of an S/4 layer of a material that has a low refraction index, for example 1.38, such as $MgF_2$. Alternatively, a coating of two layers may be applied such as, for example, an S/4 layer that has a high refraction index of, for example, n=1.70, with a low-refraction index layer on top. It is also possible to use a multilayer coating such as, for example, S/4 with n=1.7, on top of this S/2 with n=2.0 and on top of that S/4 with n=1.38. S is then selected to be a wavelength in the visible area of the spectrum, for example, in the middle of the spectrum.

From KR 9311373 is known a rectangularly shaped unit of an electric lamp and reflector for projection on rectangular screens.

These and other aspects of the invention will be apparent from and elucidated with reference to the embodiments described hereinafter.

BRIEF DESCRIPTION OF THE DRAWINGS

In FIG. 1, a reflector body 1 is illustrated having a substantially rectangular shape. Transparent plate 30 is enclosed by a raised edge 27 of side faces 25 which in the four corners of the rectangle changes into lugs 22. Through transparent plate 30 is visible a reflecting surface 3 having in the middle an electric lamp 10 with a current conductor 17.

In FIG. 2, the unit of electric lamp and reflector has a reflector body 1 rectangular in front elevation and having a reflector part 2 with a concave, for example, paraboloidally curved reflecting surface 3 with an optical axis 4, and a hollow neck-shaped portion 5 surrounding the optical axis and integral with the reflector body. In another embodiment, the surface 3, may be shaped ellipsoidally. In the embodiment shown, the reflector body 1 is made of glass and has a metal coating, for example, an aluminum coating as a reflectorizing element. The body 1, may also be made of metal or plastic. The unit also has an electric lamp 10 comprising a light-transmitting lamp vessel 11, for example, of quartz glass, sealed in a vacuumtight manner, enclosing a cavity 12 in which an electric element 13, an electrode pair in the Figure, having a luminous portion 8 (for example, a 1.3 mm discharge arc) is arranged. The light generated in the electric lamp 10 is issued to the exterior either directly or via reflection in the reflecting surface 3 through the light emission window 28.

Figure 1:
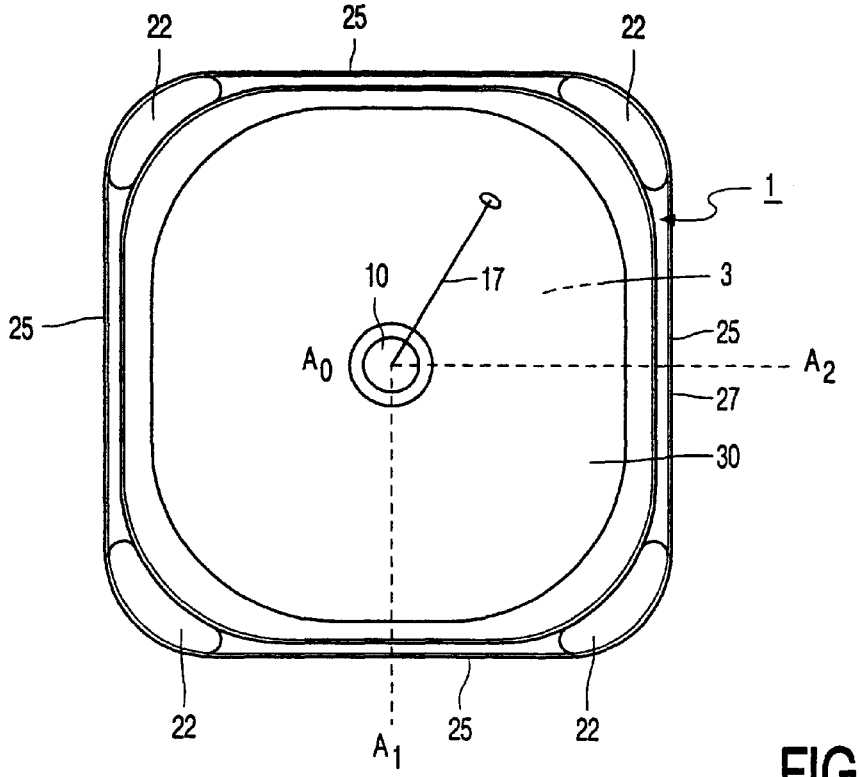
FIG. 1 shows a first embodiment in front elevation.

The lamp vessel has a first 14 and a second end portion 15 lying opposite each other with a seal through which a respective current conductor 16, 17 runs which is connected to the electric element 13 and issues from the lamp vessel 11 to the exterior. The lamp shown is a high-pressure mercury discharge lamp which has a pressure of approximately 175 bar or more during operation. The lamp vessel contains besides mercury a rare gas, for example, argon and bromine. The electric lamp 10 which consumes a power of approximately 70 to approximately 150 W is fixed in the reflector body 1 by means of cement 19 in the embodiment shown. The first end portion 14 is inside the neck-shaped portion 5, the cavity 12 inside the reflecting portion 2 and the electric element 13 on the optical axis 4. An electric contact 21 to which a current conductor 16 is connected is fixed to the neck-shaped portion 5 of the reflector body 1 by means of cement 29. The current conductor 17 issues from the second end portion 15 through the reflector portion 2 to the exterior and is connected there to a contact member 9.

The neck-shaped portion internally has a narrowed portion 6 which merges with the reflecting surface 3 and widens internally from the narrowed portion conically towards the electric contact 21. The lamp shown 10 emits light at an angle of ±45° to the perpendicular on the discharge path. Thanks to the narrowed portion, substantially all the generated light is directed towards the reflecting surface 3 where the latter is paraboloidally curved and not deformed by the rounded portion merging with the neck-shaped portion.

The reflector body 1 shown is closed off by a transparent plate 30 which is fixed with cement 39, flush-mounted relative to a lug 22 and surrounded by a raised edge 27 of side faces 25, but could alternatively be mounted with other means, for example, a metal ring. The lug 22 has a pressing surface 23 on a side facing towards the reflecting surface 3. The transparent plate 30 in the Figure has an anti-reflection coating 31.

Figure 2:
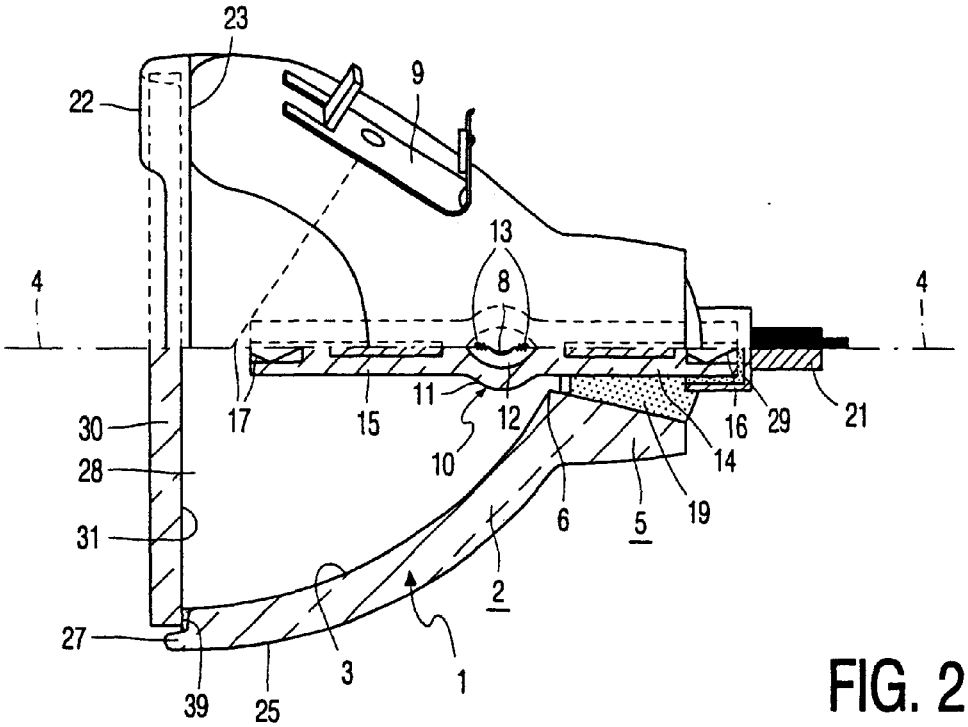
FIG. 2 shows a side elevation of the first embodiment partly cut away along line $A_0$–$A_1$ and $A_0$–$A_2$.
Figure 3:
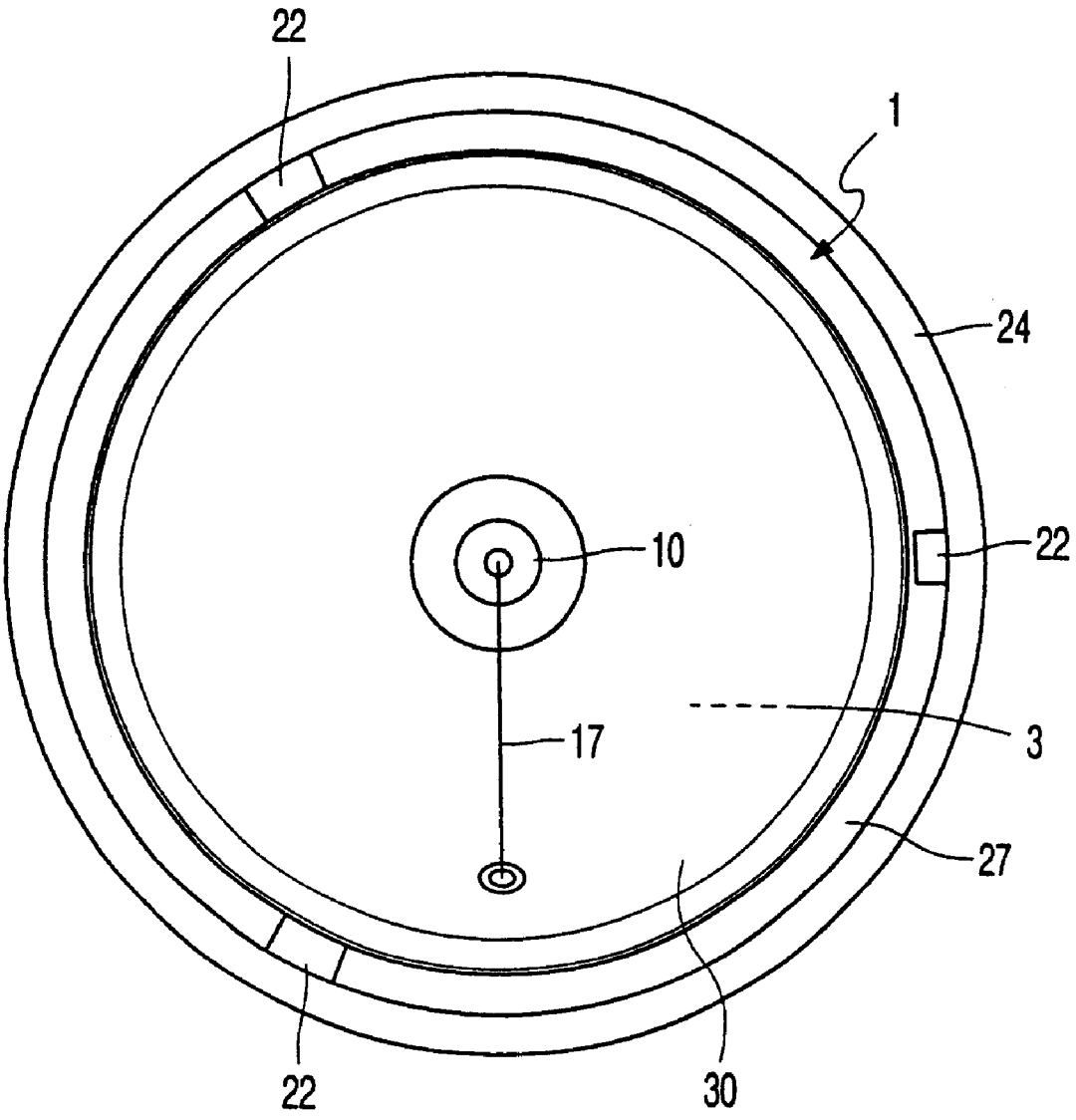
FIG. 3 shows a front elevation of a second embodiment.

FIG. 3 shows an embodiment of a unit having a round reflector body 1. Parts corresponding to parts in FIGS. 1 and 2 have like reference characters. Transparent plate 30 is surrounded by the raised edge 27 and on the raised edge 27 there are three lugs 22. A pressing flange 24 surrounds the raised edge 27 with lugs 22. Through transparent plate 30 the reflecting surface 3 is visible having in the middle the electric lamp 10 with the current conductor 17.

What is claimed is:

1. A unit of an electric lamp and reflector, comprising a reflector body including a reflector part with a concave reflecting surface having an optical axis, a hollow neck-shaped portion integral with said reflector body, and a light emission window surrounding said optical axis;

an electric lamp comprising a light-transmitting vessel sealed in a vacuumtight manner, enclosing a cavity and having, a first and a second mutually opposing sealed end portion, an electric element arranged in the cavity and respective current conductors connected to the electric element, extending through said sealed end portions and issuing from the lamp vessel to the exterior, the electric lamp being fixed in the reflector body with the first end portion inside the neck-shaped potion, while the cavity lies within the reflecting portion and the electric element is on the optical axis wherein the reflector body has lugs on a side nearest the light emission window.

2. A unit of electric lamp and reflector as claimed in claim 1, wherein the reflector body in a cross-section transverse to the optical axis at the light emission window has a rectangular shape.

3. A unit of electric lamp and reflector comprising a reflector;

an electric lamp fixed at a first end of the reflector, wherein a second end of the reflector defines a light emission window and has lugs; and a transparent plate which closes off the reflector body while the lugs extend above the transparent plate.

4. A unit of electric lamp and reflector as claimed in claim 3 wherein the lugs each have a pressing surface.

5. A unit of electric lamp and reflector as claimed in claim 3 wherein the transparent plate has an anti-reflecting coating.

6. A lighting unit comprising:

a lamp;

a reflector that surrounds said lamp, said reflector having a front side that defines an emission window for exit of light emitted from said lamp, wherein said reflector has lugs at said front side; and a transparent plate located at said front side, wherein said the lugs extend above the transparent plate.

* * * * *